United States Patent [19]

Higuchi et al.

[11] 4,232,185

[45] Nov. 4, 1980

[54] ELECTRICAL INSULATOR WITH SEMICONDUCTIVE GLAZE

[75] Inventors: Noboru Higuchi, Nagoya; Takayuki Ogasawara, Konan; Shoji Seike, Nagoya, all of Japan

[73] Assignee: NGK Insulators, Ltd., Nagoya, Japan

[21] Appl. No.: 900,935

[22] Filed: Apr. 28, 1978

[30] Foreign Application Priority Data

May 2, 1977 [GB] United Kingdom ..... 18383/77

[51] Int. Cl.[3] ..... H01B 3/10; H01B 3/12

[52] U.S. Cl. ..... 174/140 C; 174/137 A

[58] Field of Search ..... 174/137 A, 140 C, 141 C, 174/209, 211

[56] References Cited

U.S. PATENT DOCUMENTS

| | | | |
|---|---|---|---|
| 3,888,796 | 6/1975 | Nigol | 252/518 |
| 4,112,193 | 9/1978 | Higuchi et al. | 174/137 A X |

FOREIGN PATENT DOCUMENTS

| | | |
|---|---|---|
| 982600 | 2/1965 | United Kingdom . |
| 1068219 | 5/1967 | United Kingdom . |
| 1098958 | 1/1968 | United Kingdom . |
| 1112765 | 5/1968 | United Kingdom . |

OTHER PUBLICATIONS

"Development of New Semiconductor Glaze Insulators," Nigol et al., IEEE Transactions on Power Apparatus and Systems, vol. PAS-93, No. 2, pp. 614-622, Mar./Apr. 1974, Published by IEEE, NY, NY.

*Primary Examiner*—B. A. Reynolds
*Assistant Examiner*—E. F. Borchelt
*Attorney, Agent, or Firm*—Lewis H. Eslinger

[57] ABSTRACT

An insulator with a tin oxide semiconductor glaze coating has a portion at least 100μ thick extending from the glaze surface in which the ratio of the maximum to the minimum volume resistivity is not more than 30. It is found that such glazes display marked improvement in resistance to deterioration under unfavorable conditions.

2 Claims, 6 Drawing Figures

ELECTRICAL INSULATOR WITH SEMICONDUCTIVE GLAZE

This invention relates to an electrical insulator having a coating of a tin oxide-containing semiconductive glaze.

Under conditions of atmospheric pollution, an electrical insulator having a coating of a semiconductive glaze composition over its entire surface (hereinafter referred to simply as semi-conducting glaze insulator) exhibits much better electrical properties than a conventional insulator with a coating of an insulating glaze. This is due to the fact that a wet pollution material on the surface of the insulator tends to be dried by the heat generated in the semiconductive glaze layer by a minute leakage current which flows therethrough. Also, the voltage gradients along the insulator surface can be less severe with the semiconducting glaze.

Consequently, the use of semiconductive glazed insulators in polluted areas reduces flashover faults caused by pollution, which means that countermeasures to the pollution, such as an application of a silicone greasing or over-insulation design, are not required.

While semiconducting glaze insulators have these helpful properties, they suffer from the disadvantage that the glaze is liable to be damaged by electrolytic corrosion in polluted or moistened conditions. Thus, the iron oxide-type semiconducting glaze insulators which were among the first proposals in the art of semiconducting glaze insulators, have not been widely used due to a strong tendency of the glaze to deteriorate when subjected to polluted conditions, such deterioration resulting in an increase in the electrical resistance of the glaze. The electrolytic corrosion of the iron oxide-type glazes is such that the electrically conductive constituents of the glaze composition, which include iron oxide as the main component, are dissolved in wet pollution materials when voltage is applied.

A development in this field, namely glaze compositions which include tin oxide and antimony oxide as the electrically conductive components, have an improved resistance to electrolytic corrosion because dissolution of the components is reduced. However, in long term severe conditions these glazes still suffer from deterioration in the form of roughening of the glaze surface or an increase of the surface resistivity. With advancing deterioration, the glaze gradually loses its advantageous effect of providing a predetermined but continuous and small amount of leakage current therethrough. Thus, the lifetime of such a semiconducting glaze insulator is governed by its deterioration over a period of time.

Accordingly, there is still a need for an improved semiconducting insulator having both high resistance to electrolytic corrosion and a reduced tendency to deteriorate and thus having a prolonged life.

Many tin oxide-type semiconductive glaze insulators have been hitherto proposed such as in British Pat. Nos. 982,600, 1,098,958 and 1,112,765 and U.S. Pat. No. 3,888,796. The semiconductive glazes disclosed include those prepared by admixing tin oxide to antimony oxide with the weight ratio of tin oxide to antimony oxide between 70:30 and 99:1, calcining the mixture at a predetermined temperature, and then mixing the calcined mixture with an ordinary ceramic glaze composition (hereinafter referred to simply as base glaze). The calcination is not essential and mere mixing of a mixture of tin oxide and antimony oxide in a predetermined ratio with the base glaze may produce a desired semi-conductive glaze. The mixture of these oxides is generally used in an amount between 3 and 50% by weight of the base glaze.

The above Specifications teach semiconductive glaze compositions and/or processes for producing them, and do not refer to electrolytic corrosion or deterioration of the glazes. British Pat. No. 1,068,219 has as its object the elimination of electrolytic corrosion, but no detailed explanation is given concerning this phenomenon. This patent discloses an electrical insulator including terminals attached to an insulating body having an inner semiconducting layer attached to the surface of the body, and one or more additional semiconducting layers (one of which is an outer layer) attached and electrically connected to each other and/or to the inner layer, at least one of the layers being electrically connected to at least one of the terminals. The thicknesses of the semiconducting layers are selected, in relation to the resistivities of the material or materials of which they are composed, so that the resistance between any two points on the outer surface of the outer layer, considering that layer alone, is greater than twice the resistance between the said two points through all the layers together. The intention is that, in use, the current density in the outer layer, at or near its surface, does not exceed the threshold value, whilst the other semiconducting layer or layers carry sufficient current to stabilise the insulator.

The idea behind this may be expressed as follows. The rate of corrosion increases rapidly when the density of the current flowing through a semiconductive glaze, especially through the outer surface of the glaze coating which is in direct contact with water or pollution material in the air, exceeds a certain value. Provision of an insulating layer over the semiconductive glaze is considered to be effective to eliminate electrolytic corrosion. However, if the insulating layer is made too thick, breakdown thereof is apt to result. Thus, the distinctive feature of the invention of this British patent is said to reside in the provision of a series of, preferably two, semiconductive glaze layers, the outer layer having higher electrical resistivity than the inner layer and being as thin as possible. Electrical resistivity in a direction from the outer layer towards the inner layer is made small while that in the longitudinal direction is made high whereby to minimise the current flowing longitudinally through the outer layer.

We have found, however, that the situation is more complicated than was previously thought, and that notice must be taken of factors which are not touched on in that British specification. More particularly, we have found that, even in the case where the glaze is a single layer of a semiconductive glaze, the internal resistivity varies considerably from place to place within the glaze layer, and in particular it is high near the interface with the insulating body. Thus, current does not flow uniformly through the thickness of the layer of semiconductive glaze. Accordingly, the phenomena of deterioration including electrolytic corrosion is dependent not simply on the current expected to be flowing through the uppermost layer of the semiconductive glaze coating, but is also greatly influenced by the current distribution throughout the layer, in other words, by the volume resistivity distribution of every minute portion of the semiconductive glaze layer.

According to the present invention there is provided an insulator including an insulator body coated with a tin oxide-antimony oxide type semiconductive glaze including tin oxide and antimony oxide, of which a portion having a depth of at least 100μ from the glaze surface toward the insulator body in the thickness direction of the glaze has a ratio of the maximum volume resistivity to the minimum volume resistivity of not more than 30.

Following the discovery that the volume resistivity varies from place to place within the glaze layer, we have found that, in order significantly to decrease deterioration under polluted conditions, it is necessary to control the volume resistivity variation at least to the extent just described, and indeed it is preferable for the said ratio to be not more than 10.

The present invention and the technical background thereto, will now be described with reference to the accompanying drawings, in which.

As described previously, insulators having coatings of conductive glaze may be obtained, for example, by incorporating a conductivity-producing substance such as tin oxide-antimony oxide in a base glaze to form a glazing slip, applying the slip to the surface of an insulator body to a predetermined thickness, and firing it. The internal microstructure of the resulting conductive glaze is such that the conductive substance is in contact with itself in the glaze and forms a conductive network, and thus produces conductivity in the glaze.

Our investigations, however, have revealed that a uniform conductive network does not occur in the glaze. We have found that, especially near the interface between the conductive glaze and the insulating body, the coating generally has a high resistivity, presumably owing to reaction between the insulating body and the conductive glaze. As a result, the current will not flow uniformly throughout the thickness of the conductive glaze but will instead flow mainly through a particular part of the glaze.

Figure 1:
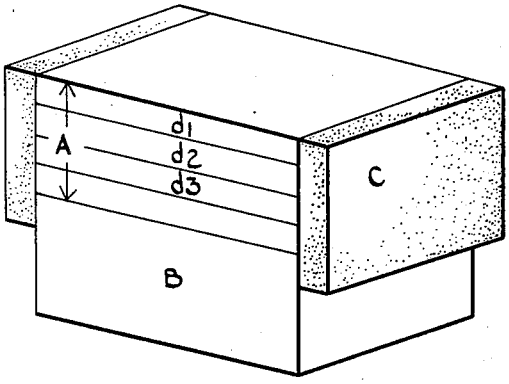
FIG. 1 is a schematic view illustrating a sample used to measure volume resistivity of minute portions of a semiconductive glaze of an insulator.
Figure 2:
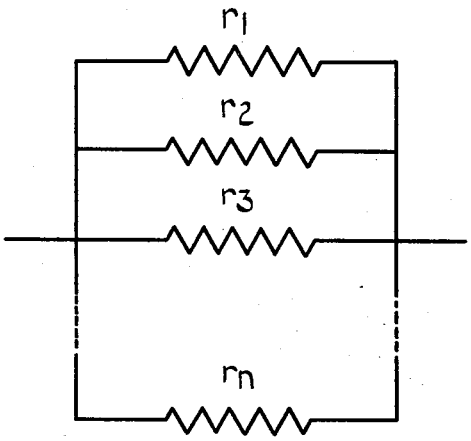
FIG. 2 is a circuit diagram of a model of the conductive glaze.

In order to examine the conductive network in minute portions of the glaze, we have devised a method which involves incrementally abrading the surface of the fired conductive glaze coating, measuring the volume resistivity of the conductive glaze of the sample after each increment of abrasion, and determining the volume resistivity of the minute abraded portions of the conductive glaze from the measured values obtained. FIG. 1 is a schematic view showing a measuring sample, and FIG. 2 is a circuit diagram of a model of a conductive glaze.

Since the conductive network within the conductive glaze is distributed three-dimensionally, the equivalent circuit is extremely complicated. Therefore the model of FIG. 2 is selected to represent a glaze on the assumption that the conductive glaze layer is analogous to resistors aligned parallel to one another in the planar direction of the glaze.

In FIG. 1, A represents a conductive glaze layer as a whole; B, a porcelain insulator body; C, silver paint used for connections for measuring resistivity; $d_1$, an incremental layer to be removed on the first abrasion; $d_2$, etc, layers to be lost by the second and subsequent abrasions. The resistivity of the $d_1$ portion removed by abrading can therefore be computed from the resistivity of the entire glaze layer before abrading which consists of layers $d_1$, $d_2$, $d_3$, . . . and that of the glaze layer composed of layers $d_2$, $d_3$, . . . after abrading. In this way, the volume resistivity of the $d_1$ portion is determined.

Figure 3:
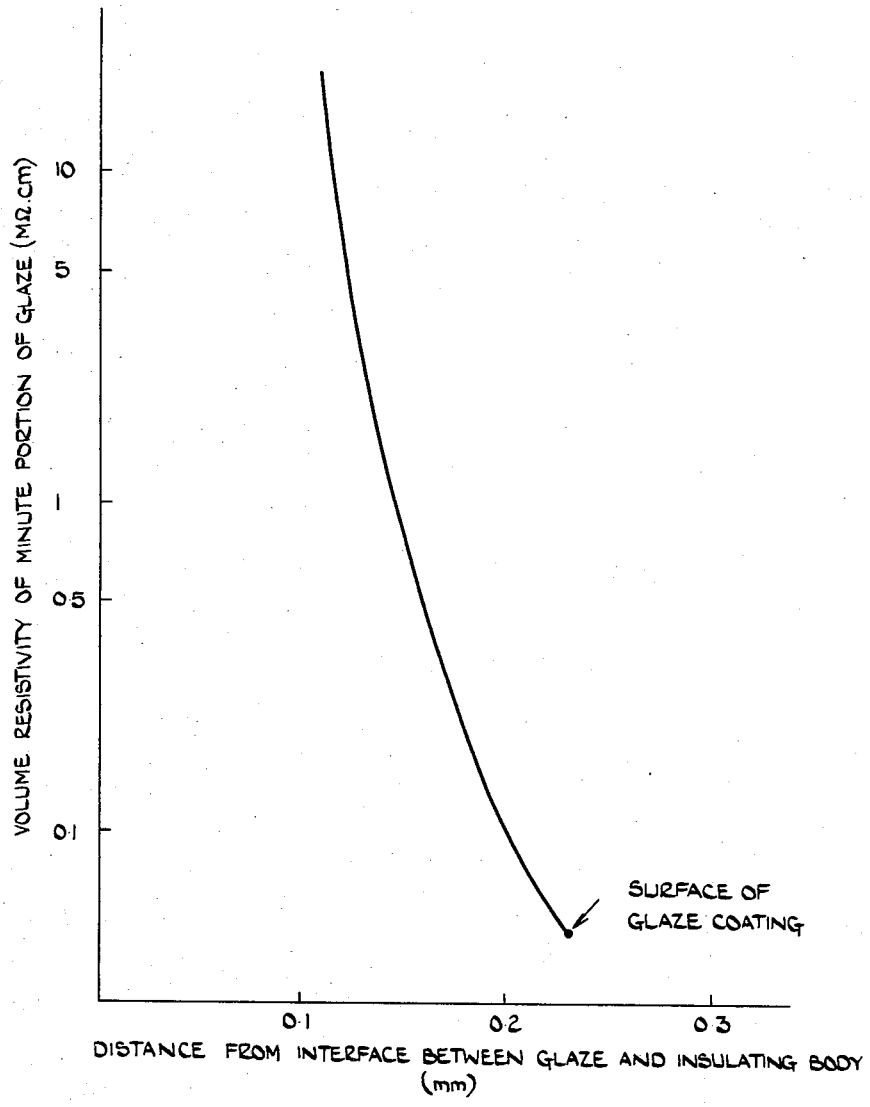
FIG. 3 to FIG. 6 are graphs showing volume resistivity distributions within semiconductive glazes, wherein the ordinate axes are on a logarithmic scale, FIGS. 4 to 6 being graphs relating to Examples 1 to 3, respectively.

One example of the volume resistivity (hereinafter referred to as ρ) distribution of the internal microstructure of a conductive glaze layer determined in this way is shown in FIG. 3. As may be seen in FIG. 3, the ρ-distribution pattern is such that the volume resistivity is high at the vicinity of the interface between the semiconductive glaze and insulating body and is low at the surface region of the semiconductive glaze. Accordingly, the current flowing through the conductive glaze layer is concentrated mainly on those portions which have a low ρ, i.e. the parts at or near its outer surface.

Conventional conductive glazes generally show such a ρ distribution pattern, and they change markedly in resistivity upon deterioration during service. The detailed mechanism of this phenomenon is not yet clear, but it is presumed that the increase in resistivity results from: (a) breakage of the conductive network due to thermal breakdown of microstructure portions in those areas where the current density is high, and/or (b) the erosion of portions at the vicinity of the glaze surface in which the resistivity is low, due to roughening of the glaze surface by electrolytic corrosion.

As has been mentioned, we have found that the ρ distribution pattern affects the change of resistance which occurs upon deterioration of the conductive glaze insulator during long-term service. More specifically, we have found that conductive glazes in which a depth of at least 100μ in the direction of the thickness of the glaze surface and having a $\rho_{max}/\rho_{min}$ ratio (wherein the $\rho_{max}$ is the maximum value of ρ, and $\rho_{min}$ is the minimum value of ρ) of not more than 30, and preferably not more than 10, change very little in resistance even when exposed to deteriorating conditions for a long period of time. The ideal pattern for the ρ distribution would be an even pattern, i.e. where ρ is the same at every part of the conductive glaze layer. In practice, however, a very considerable advance is obtained even if the distribution of ρ is not in an even pattern, but is as defined above, which is more even than in previous glazes.

The said greater evenness in the ρ distribution could be obtained by minimising the reaction at the interface between the conductive glaze and the insulator body to prevent the increase of ρ at this part and, at the same time, decreasing the total thickness of the glaze layer so as to adjust the surface resistivity to a predetermined value. Alternatively, the desired pattern can be obtained by increasing the resistivity at the regions in the glaze layer which normally have low resistivity while increasing the thickness of the regions having such increased resistivity so as to adjust the overall surface resistivity to a predetermined value. With a glaze obtained by the former method, the current density is, however, high because of the decreased thickness of the glaze and the glaze is liable to be adversely affected by flaws on its surface due to its thinness. For this reason, the latter method is preferred, wherein minute portions in the glaze layer are permitted to have an increased volume resistivity and the thickness of the glaze is increased so as to obtain a desired overall surface resistivity. In one specific method, an increased ρ value in the minute portions of the glaze and an increased glaze thickness may be obtained by using a reduced content of the electrically conductive oxide component in the glaze. In this case, however, the conductive oxide may disperse non-uniformly in the glaze, and in particular, crazed pitting tends to occur on the surface of the glaze layer during service. It is desirable, therefore, to increase the thickness of the glaze layer while also increasing the amount of the oxide in the glaze. For this purpose, the proportion of, for example, tin oxide and antimony oxide may be changed or such a base glaze as has a composition capable of giving an increased surface resistivity may be used. In an alternative, it is possible to include a metal oxide in addition to tin oxide and antimony oxide, such as niobium oxide, yttrium oxide, molybdenum oxide or vanadium oxide, and this increases the resistivity of the conductive parts of the glaze.

Three examples concerned with glazes of various compositions will now be described to demonstrate the relationship between $\rho$ distribution and deterioration in use which is the basis of the present invention.

EXAMPLE 1

Figure 4:
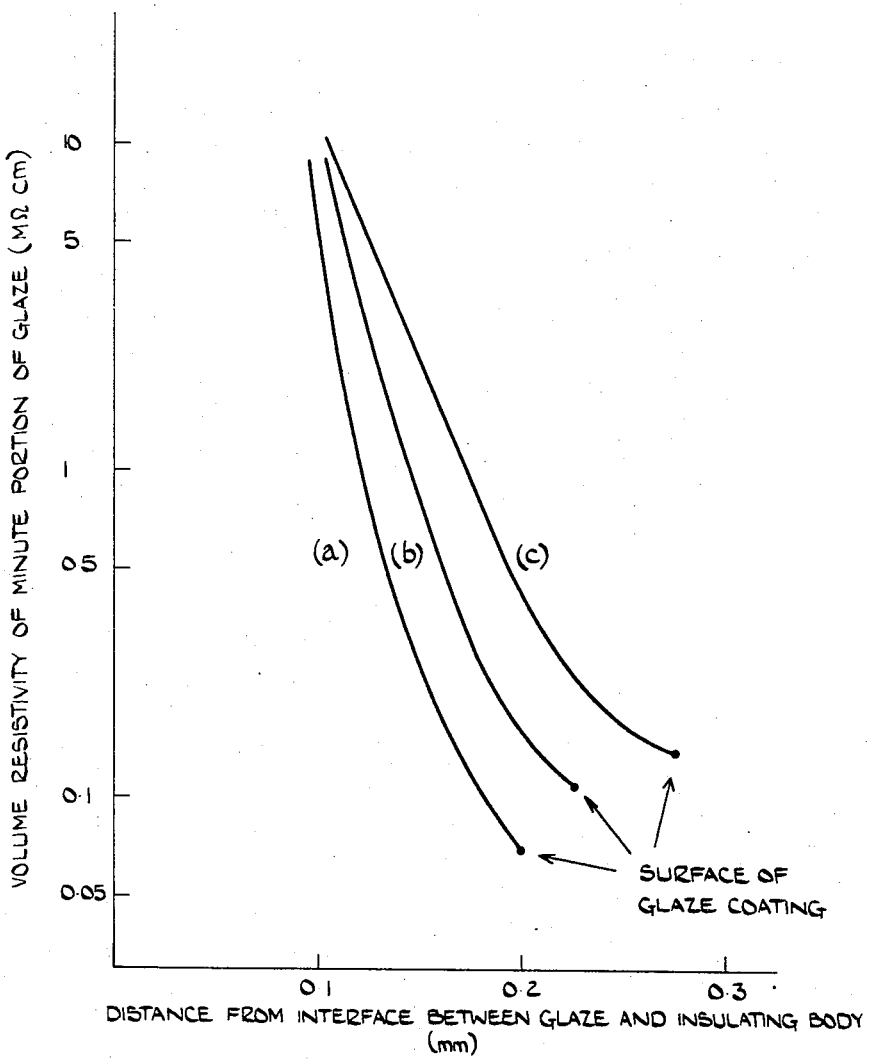

Conductive glaze slips having the compositions shown in (a), (b) and (c) in Table 1 were prepared, and applied to the surfaces of 250 mm disc-type insulator bodies to a thickness of 0.23 to 0.28 mm in the case of the glaze composition (a), to a thickness of 0.25 to 0.32 mm in the case of the glaze composition (b) and to a thickness of 0.35 to 0.40 mm in the case of the glaze composition (c). After drying, each of the coated insulators was fired at a maximum temperature of 1280° C. with a retention time of 3 hours. In all cases, the fired insulators had a surface resistivity of 10 to 50 megohms per square. Hardware fittings were bonded with cement, and a metal was then sprayed on the cement surface between the fittings and the conductive glaze to allow electric conduction. When a voltage of DC 10 KV was applied between the fittings, the resistance of the insulator was 17 megohms for glaze compositions (a), 16 megohms for the glaze composition (b) and 19 megohms for the glaze composition (c). Using samples cut out from the surface of each of the insulators having glaze compositions (a), (b) and (c) the $\rho$ distributions within the glaze layers were measured, and the results are plotted in FIG. 4. The $\rho_{max}/\rho_{min}$ value of a portion of the glaze layer of a thickness of 100 $\mu$ from the surface of the glaze layer toward the insulator body was 69 for the glaze composition (a), 27 for the glaze composition (b) and 7 for the glaze composition (c) so that in this Example, glazes (b) and (c) are within the present invention.

Other insulators with fired glaze compositions (a), (b) and (c), having resistances of 17, 16 and 19 megohms respectively, were simultaneously produced for testing their resistance to corrosion. The application of the glaze composition and firing were conducted under the same conditions as mentioned above. The surfaces of these insulators were then soiled with salt and kaolin and each insulator was subjected to an accelerated deterioration test, wherein the insulator was placed in a fog chamber and applied with an AC voltage of 15 KV for 4,000 hours. After the test, the insulator with the glaze composition (a) was found to have a resistance of 24.5 megohms, showing an increase of about 44%, the insulator with the glaze composition (b) to have a resistance of 17 megohms, showing an increase of only about 6%, and the insulator with the glaze composition (c) to have 19.5 megohms, showing an increase of about 3%. The results are also shown in Table 1, and demonstrate the relationship between initial low $\rho$ variation and resistance to pollution conditions.

EXAMPLE 2

Figure 5:
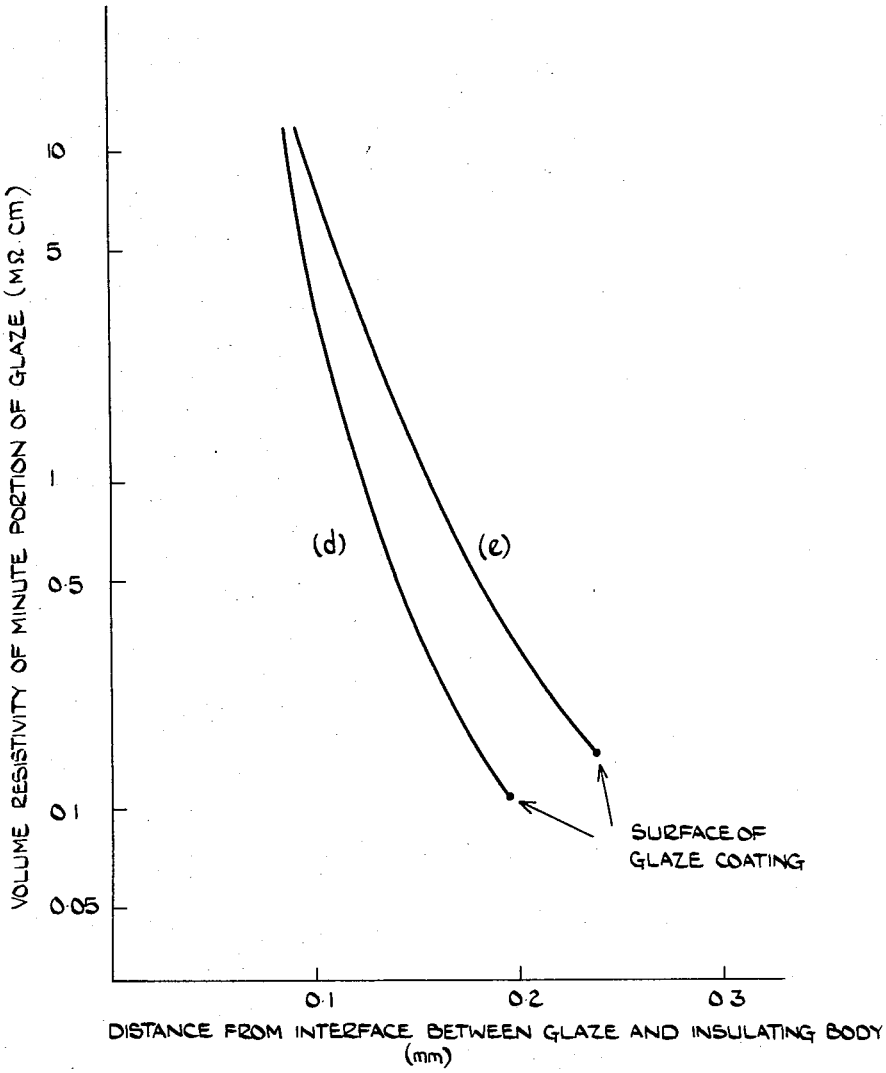

Conductive glaze slips having the compositions shown in (d) and (e) in Table 1 were prepared, and applied to the side surfaces of 40 mm×70 mm of test pieces (20 mm thickness×40 mm width×70 mm length) to a thickness of 0.23 to 0.28 in the case of (d) and 0.28 to 0.33 mm in the case of (e). After drying, the coated pieces were fired at a maximum temperature of 1270° C. with a retention time of 2 hours. Using samples cut out from the thus fired test samples, the $\rho$ distribution in the inside of the glaze layer of each of the test samples was measured. The results were as plotted in FIG. 5, (d) and (e). The $\rho_{max}/\rho_{min}$ value of a portion of the glaze layer of a thickness of 100 $\mu$ from the surface thereof toward inside thereof was 45 for glaze composition (d), and 13 for glaze composition (e), the latter being within the scope of this invention. From each of the fired test samples (d) and (e), a sample piece was cut off which has a size of 7 mm (thickness)×20 mm (width)×60 mm (length) and included the fired glaze coating. A silver paint was then applied onto the surface of the longitudinal opposite ends of the glaze coating of each of the sample pieces to form two strips of electrodes 50 mm apart and each having a width of 20 mm. Measurement of resistance between the electrodes of each sample piece revealed that the glaze (d) had resistance of 65 megohms and the glaze (e) of 83 megohms. Then, after removing one of the silver paint electrodes, each of the sample pieces was immersed, to about half of its length, into a 3% NaCl aqueous solution. An AC voltage of 3000 V was applied between the NaCl solution and the remaining strip of electrode (not immersed in the NaCl solution) for 500 hours. After the electrification test, the same kind of electrode was again provided at the removed portion to measure resistance. As a result, the resistance was 85 megohms in the case of (d), showing an increase of 31%, and was 87 megohms in the case of (e), showing an increase of 5%.

The results are shown in Table 1, and again demonstrate that the glaze within the scope of the invention performed far better when subjected to the deterioration test.

EXAMPLE 3

Figure 6:
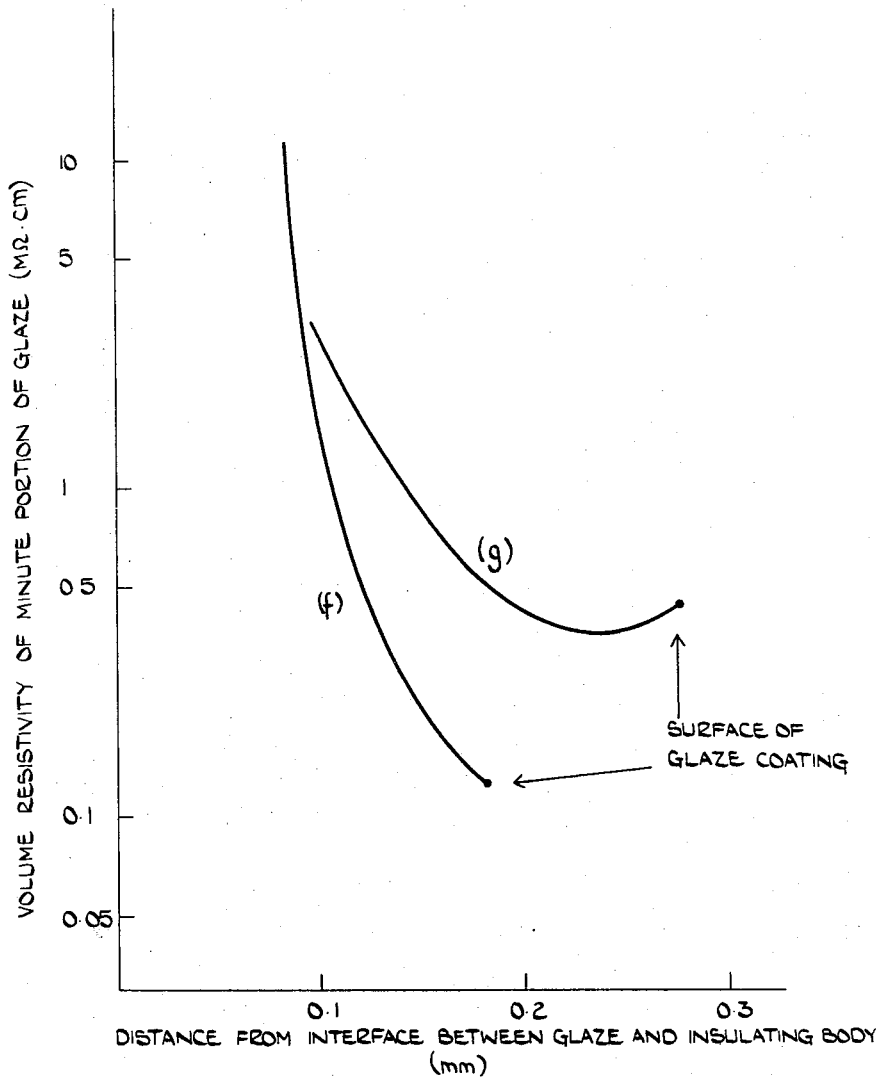

Conductive glaze slips having the compositions shown in (f) and (g) in Table 1 were prepared, and applied to the surfaces of 250 mm disc-type insulator bodies to a thickness of 0.20 to 0.26 mm in the case of glaze composition (f), and to a thickness of 0.31 to 0.38 mm in the case of glaze composition (g). After drying, the coated insulators were fired at a maximum temperature of 1260° C. with a retention time of 2 hours. Using samples cut from the thus fired disc-type insulators, the $\rho$ distribution in the inside of the glaze layer of each of the insulators was measured. The results were as shown in FIG. 6. The $\rho_{max}/\rho_{min}$ value of a portion of the glaze layer of a thickness of 100$\mu$ from the surface thereof toward inside thereof was 77 for glaze composition (f), and 1.5 for glaze composition (g), which latter sample is within the scope of the invention.

From each of the insulators which had been subjected to the $\rho$ distribution measurement, a sample piece was cut off which had a size of 10 mm (thickness)×30 mm (width)×30 mm (length) and included the fired glaze coating. A silver paint was then applied onto the surfaces of the longitudinal opposite ends of the glaze coating of each of the sample pieces to form two strips of electrodes 20 mm apart and each having a width of 30 mm. Measurement of resistance between the electrodes of each sample piece revealed that the sample (f) had a resistance of 18 megohms and the sample (g) of 23 megohms. These samples were then subjected to a constant current electrification test in which a voltage was applied for 40 minutes between the electrodes in such a way that 4 mA of AC current flowed therebetween. As a result, resistance between the electrodes of the sample (f) was found to increase to 27 megohms, showing an increase of 50%, and that of the sample (g) was to 23.5 megohms, showing an increase of 2%.

The test results are shown in Table 1.

As is evident from the above Examples, an insulator having a glaze coating having a smooth and more uniform $\rho$ distribution far better withstands the deterioration tests and thus, has a smaller change in resistance. Specifically, insulators with glazes having the $\rho_{max}/\rho_{min}$ value of less than 30 showed a resistance variation rate of less than 10% and, thus had smaller resistance variation rates than those having a greater gradient in the $\rho$ distribution pattern.

It will be appreciated from the foregoing description that insulators coated with the semiconductive glaze in accordance with this invention change little in resistance under deteriorating conditions by electrolytic corrosion, and have a much prolonged life, thus reducing the defects which have limited the wide application of conventional semiconductive glaze insulators. These advantages make it possible, without any need to consider the life of the insulators, to design insulator installations which will ensure the full exhibition of the good soil resistance characteristics and corona resistance characteristics of semiconductive glaze insulators. In addition, the use of the glazed insulators of this invention allows the construction of steel towers for transmission lines which are subject to severe contaminating conditions in service, and also permits the omission of any cleaning operation and coating with silicone grease.

TABLE 1

| Example No. | | Example 1 | | | Example 2 | | Example 3 | |
|---|---|---|---|---|---|---|---|---|
| Kind of glaze | | (a) | (b) | (c) | (d) | (e) | (f) | (g) |
| Composition of glaze (wt %) | $SnO_2$ | 30 | 31 | 34 | 28 | 30 | 30 | 33 |
| | $Sb_2O_3$ | 2 | 1 | 2 | 2 | 1 | 2 | 2 |
| | Additive | — | — | $Y_2O_3$ 1.5 | — | — | — | $Nb_2O_5$ 0.8 |
| | Base glaze | 68 | 68 | 62.5 | 70 | 69 | 68 | 64.2 |
| Composition of base glaze (Seger type) | KNaO | 0.3 | 0.2 | 0.2 | 0.2 | 0.3 | 0.3 | 0.2 |
| | CaO | 0.6 | 0.5 | 0.6 | 0.7 | 0.4 | 0.6 | 0.6 |
| | MgO | 0.1 | 0.3 | 0.2 | 0.1 | 0.3 | 0.1 | 0.2 |
| | $Al_2O_3$ | 0.6 | 0.65 | 0.55 | 0.5 | 0.7 | 0.6 | 0.5 |
| | $SiO_2$ | 6.0 | 6.5 | 6.0 | 5.5 | 6.5 | 5.5 | 5.0 |
| Water content | | 60 parts by weight per 100 parts by weight of total solids | | | | | | |
| Firing Temp. (° C.) | | 1280° C. | | | 1270° C. | | 1260° C. | |
| Retention time (hr) | | 3 hrs | | | 2 hrs | | 2 hrs | |
| $\rho_{max}/\rho_{min}$ | | 69 | 27 | 7 | 45 | 13 | 77 | 1.5 |
| Resistance before test (MΩ) | | 17 | 16 | 19 | 65 | 83 | 18 | 23 |
| Resistance after test (MΩ) | | 24.5 | 17 | 19.5 | 85 | 87 | 27 | 23.5 |
| Resistance increase rate (%) | | 44 | 6 | 3 | 31 | 5 | 50 | 2 |

We claim:

1. An insulator comprising an insulator body and a glaze coating on said body, said glaze coating consisting of a tin oxide type semiconductive glaze including tin oxide and antimony oxide, wherein, in order to render the current distribution more uniform within the thickness of the glaze coating, the ratio of maximum to minimum volume resistivity of incremental parts of the glaze in any portion of the glaze coating is not more than 30, said portion having a thickness of at least 100 microns in the direction from the glaze surface inwardly towards the insulator body.

2. An insulator as set forth in claim 1, wherein said ratio is not more than 10.

* * * * *